United States Patent [19]

Sendor et al.

[11] Patent Number: 4,915,415

[45] Date of Patent: Apr. 10, 1990

[54] INTERNALLY DISPOSED WELDED BINDING

[76] Inventors: Mortimer S. Sendor, 80-32 221 St., Queens Village, N.Y. 11427; Bernard T. Sendor, 608 Blair Dr., Westbury, N.Y. 11590

[21] Appl. No.: 277,798

[22] Filed: Nov. 30, 1988

[51] Int. Cl.[4] ..... B42D 1/00

[52] U.S. Cl. ..... 281/15.1; 283/72; 283/100; 283/105; 283/901; 281/21.1; 281/22; 281/28; 281/51; 156/908

[58] Field of Search ..... 281/15.1, 51, 21.4, 281/22, 28; 412/6, 33; 156/308.4, 73.1, 73.5, 227, 908; 283/72, 73, 100, 105, 901

[56] References Cited

U.S. PATENT DOCUMENTS

| | | | |
|---|---|---|---|
| 3,560,290 | 2/1971 | Sendor et al. | 156/227 |
| 3,925,126 | 12/1975 | Leatherman et al. | 156/908 |
| 3,943,024 | 3/1976 | Sendor et al. | 156/378 |
| 4,149,288 | 4/1979 | Sendor et al. | 156/227 |
| 4,158,587 | 6/1979 | Keller et al. | 156/227 |

*Primary Examiner*—Frank T. Yost
*Assistant Examiner*—Thomas Hamill, Jr.
*Attorney, Agent, or Firm*—Anthony J. Casella; Gerald E. Hespos

[57] ABSTRACT

A passbook is provided that substantially prevents alteration or counterfeiting. The passbook is formed from a plurality of sheets of flexible material that are bound to one another at selected locations thereon by welding to define a substantially integral stub. The free edges of the welded pages are then folded back over the welded stub such that the stub is disposed interiorly. The welded stub is difficult to disassemble and reassemble without providing some indication of tampering. Furthermore, the disposition of the welded stub enables the passbook to be laid flat without creating stresses on the stub that could result in separation or delamination.

13 Claims, 3 Drawing Sheets

INTERNALLY DISPOSED WELDED BINDING

BACKGROUND OF THE INVENTION

Many booklets require a permanent durable binding that cannot be readily disassembled, tampered with, added to or counterfeited. For example, booklets or passbooks used by many financial institutions and passports used by most governments to control international travel contain important records which, if altered, could be used for illegal purposes. Government passports, for example, include pages that are intended to identify the bearer and to thereby control the movement of certain individuals across international borders. Terrorists, narcotics dealers, fugitives and other illegal aliens with passports that have been altered to include their photograph and physical descriptions can enter countries that they would otherwise be prohibited from. It is understandable, therefore, that a very substantial illegal market exists for counterfeited or altered passports. It will also be appreciated that substantial amounts of government funds are devoted to preventing the sale of counterfeit or altered passport documents. For similar reasons, there exists an illegal demand for counterfeited or altered booklets of other types, such as passbooks used in financial institutions.

One method of supplying the demand for illegal passports or other such booklets is to manufacture a complete counterfeit product. This often is difficult with passports in view of the particular paper and printing processes used by governments to manufacture the passports. However, counterfeits will be attempted if the market demand justifies the costs. In this regard, one approach to preventing counterfeits is to make the true original sufficiently distinct and unusual to significantly complicate the counterfeiting process.

A simpler option for providing illegal passports or other such booklets is to alter an existing booklet to fit the illegal user's requirements. In particular, a substantial market exists for stolen passports which can be carefully disassembled, and re-bound with appropriate new or altered pages in accordance with the requirements of the illegal passport purchaser. For example, the typical passport includes a cover and a plurality of pages that are saddle stitched or sewed at a central fold to define the binding. One page of the passport typically will include a photograph of the intended bearer. The same page or an adjacent page may include other identifying information, such as the height, weight, hair color, eye color and other distinguishing features of the intended bearer.

The illegal merchants may simply disassemble the above described prior art booklet by merely removing the saddle stitching or sewing and separating the pages from one another. Pages bearing a photograph, physical characteristics or certain travel authorizations may then be removed, and substitute pages inserted. The reassembled passport with the substitute pages can then be re-bound by the counterfeiter using readily available saddle stitching or sewing equipment. The illegally altered passport will be extremely difficult to notice for even a trained eye, at least partly because of the many original parts included in the passbook, and the ease with which the original saddle stitching or sewing may be duplicated.

Some bound documents have included a welded seam, with a plurality of separate pages arranged in a stacked array and welded to one another along one edge. A particularly preferred welding process employs ultrasonic welding, as shown for example in U.S. Pat. No. 3,943,024 which issued to the inventors herein on Mar. 9, 1976. In accordance with ultrasonic welding techniques, the paper of the booklet to be welded may be impregnated with an appropriate resin, may have an appropriate resin applied to the edges to be bound or may be a plastic material. These aligned pages are then placed in an ultrasonic welding apparatus which applies both pressure and ultrasonic sound which compresses the aligned edges and causes the resin to weld the adjacent edges into a single substantially integral bound spine. The compression applied to the spine results in the spine having a reduced thickness or height compared to unbound portions of the array of pages. This is in contrast to other binding techniques where the thickness at the spine remains the same or increases. The welded pages are difficult to separate from one another without tearing, and any separation typically can be readily visually observed. It is even more difficult to physically separate the welded pages, take selected pages out and insert new pages without leaving some visual indication of the change. It is also difficult to reweld the pages after such a separation. Unfortunately, the prior art welded books and booklets cannot be readily placed in an open flat condition. Frequent attempts to forcibly urge these books flat for placing printed material on the pages or for carefully inspecting material previously placed thereon can result in a tearing or other such destruction of the prior art welded binding. Thus, a perfectly legitimate passport or other such booklet may appear to be tampered with after such handling.

In view of the above, it is an object of the subject invention to provide a passbook that cannot be readily altered.

Another object of the subject invention is to provide a passbook that is difficult to duplicate by a counterfeiter.

A further object of the subject invention is to provide a passbook that will remain securely bound throughout its normal usage.

Still another object of the subject invention is to provide a passbook that can be provided with an embossed or punched binding stub to further complicate any counterfeiting attempts.

An additional object of the subject invention is to provide a passbook that can be readily bound with equipment that is currently available.

SUMMARY OF THE INVENTION

The subject invention is directed to a booklet having an internally disposed, welded binding. More particularly, the booklet comprises a plurality of sheets of paper, plastic and/or other flexible sheet material disposed in a stacked array. The widths of the sheets in the array may be twice the width of each page of the passbook. Thus, the entire array of sheets may be folded in half into a booklet form to define a folded array, with the folded lines of the sheets in the array being in nested relationship to one another. Thus, the two outwardly facing sheets in the folded array may be the opposed halves of a single folded sheet, while the two innermost sheets in the folded array may also be opposed halves of a single folded sheet. This is referred to in the trade as a double leaf or four page format. As an alternative to the above described double leaf or four page format, each sheet may approximate the size of a single page of the passbook. Thus, the sheets may be merely arranged in a stacked array without folding. This alternate is referred to in the trade as a single leaf or two page format.

The array of sheets are then welded to one another by, for example, the known welding processes as identified above, and preferably by ultrasonic welding. In the array of folded sheets (double leaf/four page), the welding will define a stub along a section of the folded array extending a preselected distance inwardly from the nested fold lines. In the array of unfolded sheets (single leaf/double page), the unfolded edges will be aligned with one another, and the stub defined by the welding will extend generally adjacent selected aligned edges of the array. Typically, the welding or stub will extend inwardly from the selected edge by a distance of approximately one-sixteenth inch to three-eighth inch.

In the prior art, the welded stub portion of the sheets defines an externally disposed spine of the booklet. However, in the booklet of the subject invention, the sheets in the array are folded in opposed directions back over the weld, such that a welded stub is disposed interiorly in the booklet. For example, approximately one-half of the sheets may be rotated approximately 180° about the welded stub in a first direction, while the remaining sheets may be rotated 180° about the welded stub in the opposed direction. Thus, two sheets that are externally disposed in the initial bound condition of the booklet will be interiorly disposed in the inversely folded condition of the booklet. Conversely, two sheets that have been interiorly disposed in the initial bound condition of the booklet will define the outermost sheets of the inversely folded booklet. The booklet may be completed by inserting the booklet into a folded and appropriately printed cover. The cover may be any of the known styles currently used in bookbinding and may be permanently adhered to the outermost sheets of the bound and inversely folded array.

The above described booklet has several substantial advantages over the prior art. In particular, the welding provides a binding which cannot readily be disassembled or otherwise tampered with without showing some physical evidence of the tampering. Furthermore, the welded bonding is rigid and withstands virtually all normal forces imposed thereon except for direct tensile forces urging the bound sheets away from one another, which is difficult to achieve during normal use of the booklet. However, with the inversely folded condition described above, the normal usage of the passbook will not subject the binding thereof to the tensile forces that could urge the bound sheets apart. In particular, the inversely folded booklet described above can be laid completely flat to permit close inspection of entries therein, and to permit the entry of additional data into the pages of the booklet, such as by insertion of the booklet into appropriate office machines, typewriters or the like. Furthermore, the above described cover effectively provides a fail-safe protection which makes any intentional disassembly of the passbook especially obvious. In particular, the disassembly of the above described passbook would require a separation of the adhesively connected cover and the outwardly facing pages prior to any disassembly of the binding. Thus, in addition to the visible evidence of a tampered binding, there would be additional visual evidence of tampering to the cover.

The probability of altering the above-described inversely bound passbook can be further minimized by three-dimensional indicia on the welded internally disposed stub. For example, the internally disposed welded stub can be embossed, perforated, drilled, notched or otherwise intentionally mutilated or structured to define a pattern that would be difficult to disassemble without extensive damage and would be even more difficult to reassemble into its initial form. For example, the embossments, perforations or the like could be a repeated array of seals or logos of the entity issuing the passbook. The array of the three-dimensional indicia could be periodically altered by the issuing entity to further complicate counterfeiting or to permanently identify a particular status of the passbook bearer.

DETAILED DESCRIPTION OF THE PREFERRED EMBODIMENTS

Figure 1:
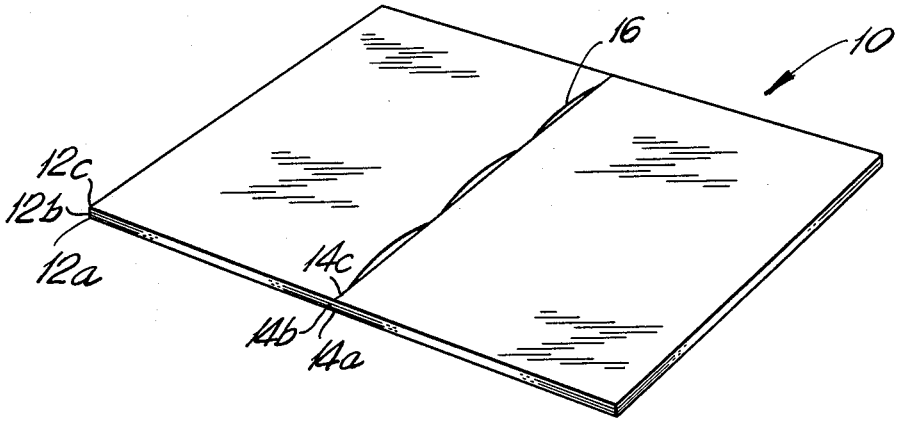
FIG. 1 PRIOR ART
FIG. 1 is a perspective view of a prior art passbook.

The prior art passbook type of booklet is indicated generally by the numeral 10 in FIG. 1. The prior art passbook 10 comprises a plurality of sheets 12*a–c* which are disposed in a generally registered stacked array and are folded in half along central fold lines 14*a–c*. The aligned and folded sheets 12*a–c* are bound together by a saddle sewing 16 which extends through the fold lines 14*a–c* of the sheets 12*a*–12*c*. The saddle sewing 16 is secured on the outwardly facing side of the bottom sheet 12*a*. A cover (not shown) may be secured to the bottom sheet 12*a* to cover the outwardly facing portions of the saddle sewing 16. The cover typically would perform a protective function, would add rigidity to the passbook 10 and would be provided with appropriate printed or embossed indicia identifying the entity that issued the prior art passbook 10.

The prior art passbook 10 is desirable in that it can be laid substantially perfectly flat as shown in FIG. 1 to readily permit inspection of indicia, information or designs put on the sheets 12*a–c*, or to permit additional indicia or the like to be placed thereon during the normal use of the prior art passbook 10. However, as noted above, the prior art passbook 10 is relatively easy to disassemble, alter and reassemble for purposes of producing an illegal or counterfeited passbook. In particular, the saddle sewing 16 can readily be removed from the prior art passbook 10 to permit the sheets 12*a*–12*c* to be separated from one another. Selected sheets 12*a*–12*c* can be discarded and replaced by a new sheet which may be imprinted with indicia identifying an illegal or unauthorized bearer of the passbook 10, or presenting incorrect information about the legal bearer. The sheets 12a–12c including any substitute sheets, may then be re-bound by a saddle sewing which will be disposed at substantially the exact location of the original saddle stitching 16. The resulting altered or counterfeited passbook will be difficult to distinguish from a true original.

The passbook of the subject invention is indicated generally by the numeral 20 in FIGS. 2–6. The term passbook, as employed herein, is suggestive of a particular end use for the preferred embodiment described below. However, the invention is not limited to any particular end use, as will be appreciated by those skilled in this art. The illustrated passbook 20 comprises a cover 22 and a plurality of sheets identified generally by the numeral 24 in FIG. 2. The cover 22 and the sheets 24 are disposed in a generally registered array. The passbook 20 further includes an inwardly directed welded stub 26 disposed on the portion of the opened passbook 20 opposite the cover 22 thereof.

Relevant steps in the formation of the passbook 20 are illustrated in FIGS. 3–6. In particular, a plurality of sheets of paper 24a–d are disposed in a generally stacked, registered array. In this embodiment the sheets are dimensioned for four page format (two leaf format). A page of flexible, foldable plastic 24p approximately one-half of the size of the paper sheets 24a–d (one leaf format) is disposed intermediate sheets 24b and 24c and in register with three edges thereof. The plastic page 24p may comprise a clear plastic sheet having a clear adhesive on one side. A removable protective sheet may be secured to the plastic. As a result, the protective sheet may be separated from the plastic, and a photograph or other identification means may be adhesively secured intermediate the clear plastic page 24p and the adjacent paper sheet 24c. It is to be understood that the array of generally registered sheets 24a–d and 24p may comprise a greater number of sheets, and may be formed with or without the plastic sheet 24p. Alternatively, the plastic sheet 24p may be the same size as the paper sheets 24a–d (i.e. two leaf format) or may be provided with or without a stub for binding. In still other alternates a plurality of sheets 24p may be provided in accordance with the requirements of the entity issuing the passbook 20.

Figure 3:
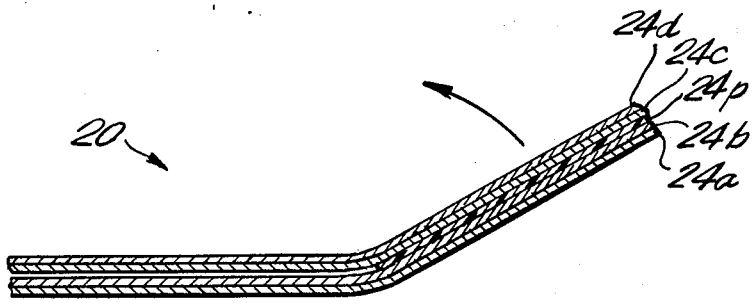
FIG. 3 is a cross-sectional view of the subject passbook at a stage during its manufacture.
Figure 4:
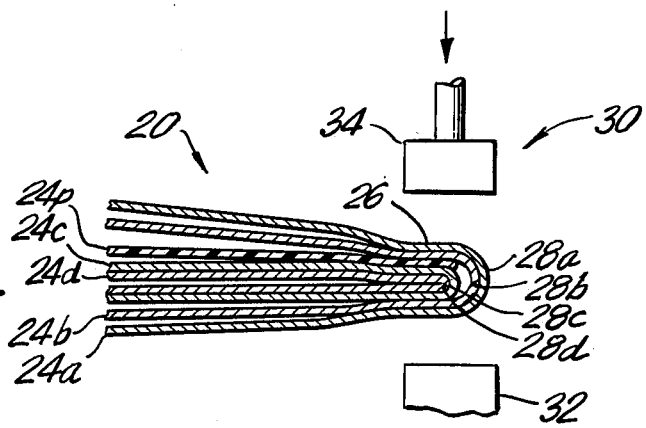
FIG. 4 is a cross-sectional view similar to FIG. 3 but at a subsequent stage in the manufacture.

The sheets 24a–d and 24p are folded relative to an approximately central location along the sheets 24a–d as indicated by the arrow in FIG. 3. This folding will create an array of aligned, nested fold lines 28a–d as shown in FIG. 4. By virtue of this folding action, the sheet 24a that had been on the bottom of the array as illustrated in FIG. 3 will define the outermost portions of the folded array depicted in FIG. 4. Similarly, the sheet 24d which had been on the top of the stacked array show in FIG. 3 will be folded upon itself to define the innermost portion of the folded array depicted in FIG. 4. In the embodiment illustrated in FIG. 4, as noted above, the plastic sheet 24p is of one leaf or two page format, and is not provided with a fold therein. Thus, page 24p terminates substantially in line with the nested fold lines 28a–d.

The sheets of paper 24a–d are at least locally impregnated with a chemical substance, such as a varnish, plastic or resin that is suitable for ultrasonic paper welding. In particular, paper sheets are available that are entirely impregnated with a chemical substance such that any appropriate location on the sheet can be subjected to ultrasonic welding. Such treated sheets may be used in the passbook 20 described and illustrated herein. Alternatively, however, the sheets 24a–d may be impregnated with an appropriate chemical substance in the vicinity of the folds 28a–28d as part of the process of forming the passbook 20.

The folded sheets 24a–d appropriately treated with an acceptable chemical substance at least in the vicinity of the folds 28a–d are then presented to an ultrasonic welding apparatus indicated generally by the numeral 30 in FIG. 4. More particularly, the ultrasonic welding apparatus 30 comprises a first support 32 against which the folded sheets are disposed and a second support 34 which is selectively movable toward or away from the first support 32. The second support 34 of the ultrasonic welding apparatus 30 is operative to exert pressure to the folded sheets 24a–d and 24p and to further provide ultrasonic energy which welds the sheets 24a–d and 24p into a substantially integral member adjacent the folds 28a–d thereof. The welded stub 26 will extend a selected distance inwardly from the outermost fold 28a, which typically will be between approximately one-sixteenth inch and one-quarter inch, with the selected width depending on the thickness of booklet and paper and the anticipated usage of the booklet.

As noted above, welded booklets in the form illustrated generally in FIG. 4 are known. However, the welded spine 26 can become damaged by urging, for example, the innermost folded sheet 24c back into its original substantially planar configuration. More particularly, the tensile forces exerted on adjacent sheets in the welded stub 26 to urge those sheets away from one another may be sufficient to tear, delaminate or otherwise destroy the welded stub 26. These potentially damaging tensile forces on the stub 26 could occur during normal use of the passbook 20, such as when an attempt is made to open the passbook 20 flat for careful inspection, for placing indicia on the pages 24a–d thereof, or for placing the booklet in a machine for printing or copying.

Figure 5:
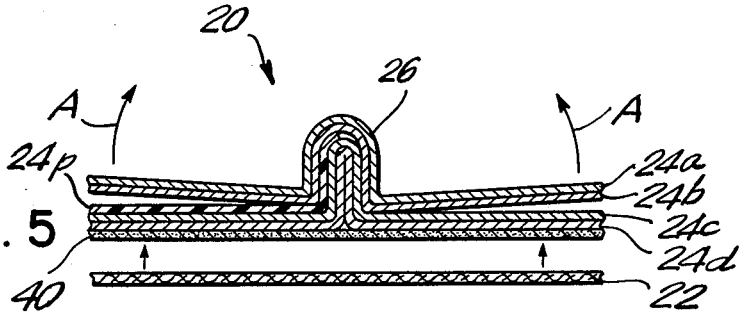
FIG. 5 is an exploded cross-sectional view of the passbook at a later stage in the manufacturing process.
Figure 6:
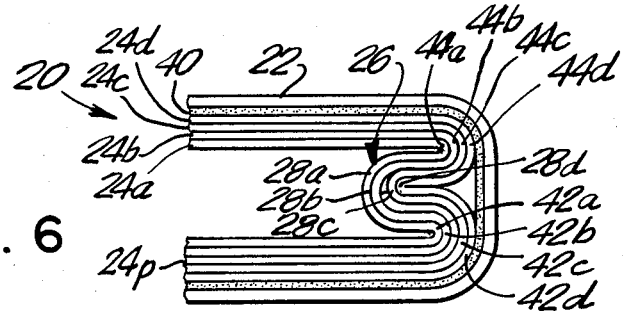
FIG. 6 is an end view of a portion of the completed passbook of the subject invention.

To avoid the above-defined problem of potential damage to the spine of a prior art welded book, and to enable flat opening, the passbook 20 of the subject invention is further formed by folding the sheets 24a–24d back over the spine 26 in generally the manner shown by the arrows "A" in FIG. 5. Thus, the sheet 24a which had defined the outermost layers as depicted in FIG. 4 will define the innermost layers of the passbook 20 as shown in FIGS. 5 and 6. Conversely, the sheet 24d which had defined the inner two pages as depicted in FIG. 4, will define outer pages as shown in FIGS. 5 and 6. The sheets 24a–d and 24p can be pressed, nipped or rolled to insure a tight, folded passbook that will remain in its closed, folded condition and which will define a narrow profile.

The cover 22 is then adhesively attached to the portions of the outermost sheet 24d extending away from the stub 26. More particularly, a layer of adhesive 40 can be applied to the sheet 24d, and the cover 22 can be fixedly secured thereto. It will be understood, of course, that the adhesive could be applied directly to the cover 22. The cover 22 typically will be a cloth, a high quality paper, plastic or a fabricated cover of cloth and paper which will be imprinted with indicia identifying the entity which issues the passbook 20. The portion of the completed passbook 20 adjacent the welded binding thereof is illustrated schematically in FIG. 6. It will be understood that the relative thickness of the passbook 20 depicted in FIG. 6 has been exaggerated to show the various constituent parts. In actual production, the welded and folded portions of the passbook 20 will be much thinner than suggested by the FIG. 6 illustration, and in fact, an ultrasonically welded binding will be compressed to a thinner dimension than existed prior to the binding.

It will be noted that the construction of the passbook 20 depicted in FIG. 6 provides the stub 26 thereof at an inwardly disposed location. Furthermore, each sheet of paper 24*a–d* includes a first fold 28*a–d* defining a portion of the spine 36 and second folds 42*a–d* and 44*a–d* extending in directions opposite to folds 28*a–d*. Thus, each sheet 24*a–d* undergoes three 180° bends as part of the forming and binding process.

Figure 2:
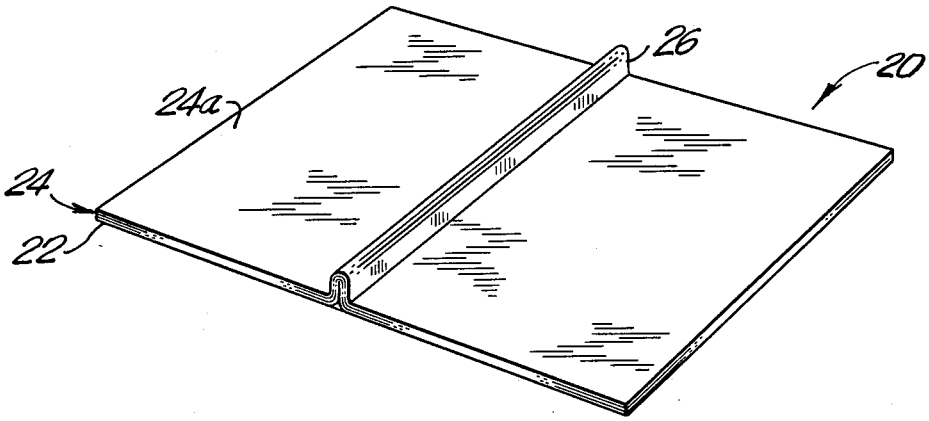
FIG. 2 is a perspective view of a passbook in accordance with the subject invention.

The completed passbook as illustrated in FIG. 6 and in FIG. 2 is securely bound by the ultrasonic welding process that cannot readily be disassembled without providing visual indication of tampering. However, as shown most clearly in FIG. 2, the passbook 20 can be laid substantially completely flat to permit close inspection of data presented therein or to permit entry of additional data. This completely flat opening of the passbook 20 will create none of the tensile stresses on the stub 26 that might be effective to disassemble the welded spine. With reference to FIG. 6, it will also be noted that the cover 22 will function to hold the welded stub 26 in a condition that substantially prevents the application of tensile forces on the stub 26 that could disengage the sheets forming the spine. Furthermore, the adhesive attachment of the cover 22 to the outermost sheet 24*d* contributes to the substantial difficulty that would be encountered by a person attempting to illegally disassemble the passbook 20. In particular, the passbook 20 could not readily be disassembled without first separating the cover 22 from the outermost sheet 24*d*. This separation of the cover 22 from the outermost sheet 24*d* would almost certainly tear or delaminate either the cover 22 or the sheet 24*d*.

Figure 7:
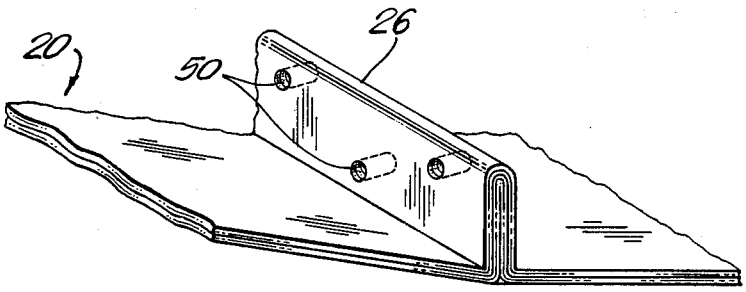
FIG. 7 is a perspective view showing a second embodiment of the welded binding of the subject passbook.
Figure 8:
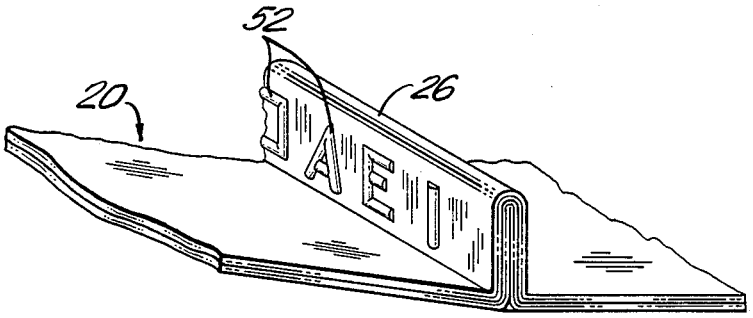
FIG. 8 is a perspective view of a third embodiment of the welded binding of the passbook.
Figure 9:
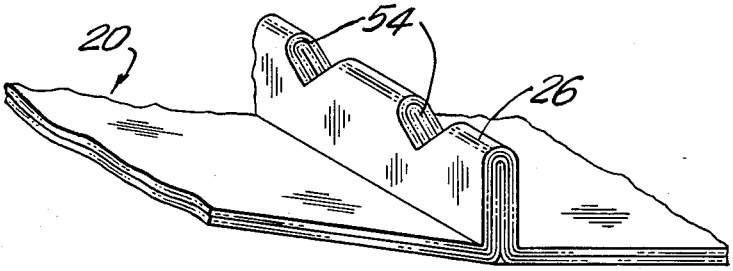
FIG. 9 is a perspective view of a fourth embodiment of the welded binding of the subject invention.

Embodiments for further complicating any attempts to completely counterfeit the passbook 20 of the subject invention or to disassemble, alter and reassemble the subject passbook 20 are shown in FIGS. 7–9. In particular, after the passbook has been ultrasonically welded to define the stub 26 thereof, the stub 26 can be provided with an appropriate three-dimensional indicia thereon. The existence of a particular pattern of three-dimensional indicia can make the disassembly and reassembly or the new copying more difficult. Thus, as shown in FIG. 7, the three-dimensional indicia may comprise a particular pattern of apertures 50 extending through the stub 26. The exact location of apertures can be checked against a pre-established pattern. Furthermore, the existence of the apertures will increase the probability of damage to the spine portions resulting from disassembly and will make proper alignment of the apertures extremely difficult upon any reassembly.

The three-dimensional indicia may further comprise identification means relating to the intended original bearer of the passbook 20. For example, as shown in FIG. 8, the indicia on the stub 26 may comprise an array of alpha-numeric indicia to identify the name or number assigned to a particular original bearer. For example, the indicia 52 on the stub 26 as shown in FIG. 8 may correspond to the height and eye color of the original bearer. This permanent indicia not only makes disassembly and reassembly of the passbook 20 difficult but makes it further difficult for the illegal bearer of a passbook 20 to correspond to the permanent indicia presented in the stub 26 as shown in FIG. 8.

FIG. 9 shows still another variation of three-dimensional indicia which may be used by itself or in combination with those shown in FIGS. 7 and 8. In particular, FIG. 9 shows cut-out portions at spaced apart locations along the folds 28*a–*28*d* of the stub 26. These cut-out portions 54 can be disposed to correspond to a preselected pattern.

It will be understood that the indicia shown in FIGS. 7–9 can be added to to further complicate the verification processes, thereby rendering alteration and counterfeiting even more difficult.

In summary, a passbook is provided with an inverted welded binding. The bound stub which defines the spine of the passbook is achieved by ultrasonic welding to achieve a compressed welded stub, and the pages of the passbook are then folded back over the stub such that the stub is interiorly disposed relative to the pages. The welded stub is difficult to disassemble and reassemble without providing some visual indication of tampering. Furthermore, the interior disposition of the welded stub enables the passbook to be opened completely flat without affecting the integrity of the stub. The cover adhered to the outermost pages of the passbook further retains the stub in its secure welded condition and makes disassembly and reassembly even more difficult and produces a finished effect. The stub can be provided with appropriate three-dimensional indicia to further complicate alteration or counterfeiting and to provide additional interiorly disposed checks on authenticity.

While the invention has been described with respect to certain preferred embodiments, it is apparent that various changes can be made without departing from the scope of the invention as defined by the appended claims. For example, it will be appreciated by persons skilled in this art that the interiorly disposed binding can be achieved by a stacked array of sheets that are bound along an external edge (single leaf or two page format), rather than binding along a fold (double leaf or four page format). It will further be appreciated that the passbook may be provided without a plastic page, with more plastic pages or with plastic pages that are the exact size of each sheet in the inversely folded array. Furthermore, the booklet may be formed entirely with sheets of a material other than paper.

What is claimed is:

1. A booklet formed from a plurality of generally registered pages secured to one another at an elongated, welded stub defining a spine of said booklet, at least one of said pages being folded in a first direction relative to said stub and the remainder of said pages being folded in a direction opposite said first direction relative to said stub such that said stub is disposed intermediate said at least one page and the remainder of said pages, said booklet further comprising a cover secured outwardly of outermost pages in said booklet and extending continuously between said outermost pages and across an outwardly facing portion of said welded stub.

2. A booklet as in claim 1 wherein said cover is adhered in face-to-face relationship to the outermost pages in said booklet.

3. A booklet as in claim 2 of double leaf format, such that said booklet comprises a plurality of pairs of pages, with the pages in each said pair being formed from a unitary sheet of material.

4. A booklet as in claim 3 wherein one page in each said pair is folded to be disposed on one side of said stub, and wherein the other page in each said pair is folded to be disposed on the other side of said stub.

5. A booklet as in claim 2 further comprising at least one plastic page having adhesive means on at least one side thereof for receiving identification means to identify a bearer of the booklet.

6. A booklet as in claim 1 further comprising three-dimensional indicia formed in said stub.

7. A booklet as in claim 6 wherein said indicia comprises an array of embossments in said stub.

8. A booklet as in claim 6 wherein said indicia comprises an array of perforations in said stub.

9. A booklet comprising a plurality of pairs of pages disposed generally in register with one another, the pages in each said pair being substantially unitary with one another and being connected to one another along a fold line, said pairs being disposed such that the fold lines thereof are in abutting nested relationship to one another, said pages being welded to one another generally adjacent said nested fold lines to define a stub, said pages being further folded relative to said stub such that a plurality of pages are disposed on one side of said stub, and such that the remainder of the pages are disposed on the other side of said stub, said booklet further comprising a cover folded about said stub and said array of pages and adhesively attached in face to face relationship with the outermost pages in said booklet, whereby the booklet is substantially tamper resistant.

10. A booklet as in claim 9 further comprising at least one plastic page welded into said stub generally in register with the other pages of said booklet.

11. A booklet as in claim 9 wherein said stub comprises a three-dimensional deformation for further preventing tampering to said booklet.

12. A booklet as in claim 11 wherein the deformation comprises an array of embossments in said stub.

13. A booklet as in claim 11 wherein the deformations define an array of perforations.

* * * * *